United States Patent [19]

Groshans

[11] 3,973,362

[45] Aug. 10, 1976

[54] SANDING SHOE

[75] Inventor: Joseph R. Groshans, Clinton, N.Y.

[73] Assignee: Chicago Pneumatic Tool Company, New York, N.Y.

[22] Filed: June 6, 1975

[21] Appl. No.: 584,577

[52] U.S. Cl. ..... 51/386; 51/170 R

[51] Int. Cl.[2] ..... B24D 17/00

[58] Field of Search..... 51/170 R, 170 TL, 170 MT, 51/382–386, 358

[56] References Cited

UNITED STATES PATENTS

| | | | |
|---|---|---|---|
| 2,546,087 | 3/1951 | Burleigh | 51/385 |
| 3,224,149 | 12/1965 | Harrington et al. | 51/386 |
| 3,822,518 | 7/1974 | Sjostrand | 51/386 |

*Primary Examiner*—James L. Jones, Jr.

*Attorney, Agent, or Firm*—Stephen J. Rudy

[57] ABSTRACT

A sanding shoe attachable to a reciprocable carrier in a hand-held portable sanding machine, the shoe having bulbous ends over which ends of sandpaper applied to a cushioned bottom of the shoe are extended and clamped between a pair of jaws in over-center lever operable clamping mechanisms, the latter having projections for centralizing the lever in its support and abutments cooperable with the lever to restrain it in its actuated condition against vibratory release.

4 Claims, 9 Drawing Figures

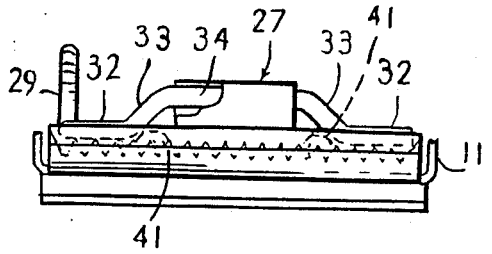
FIG. 4
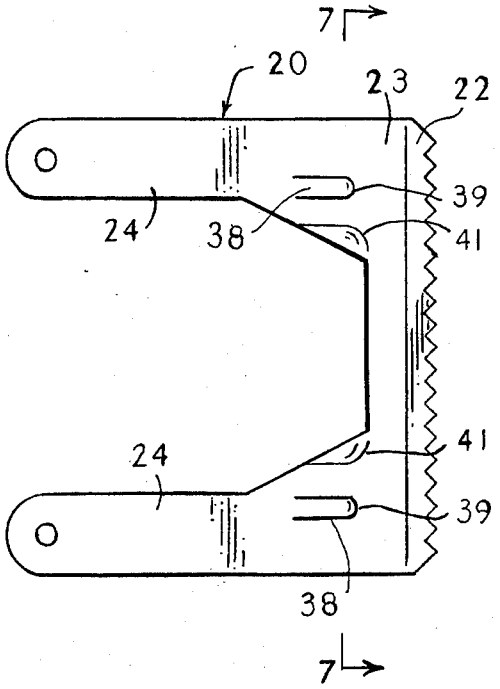
FIG. 5
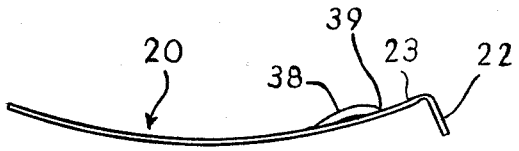
FIG. 6
FIG. 7
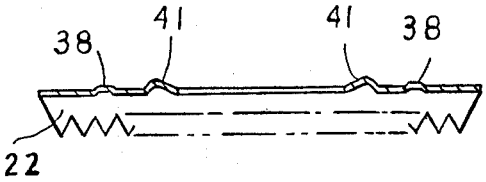
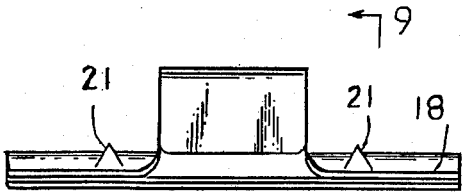
FIG. 8
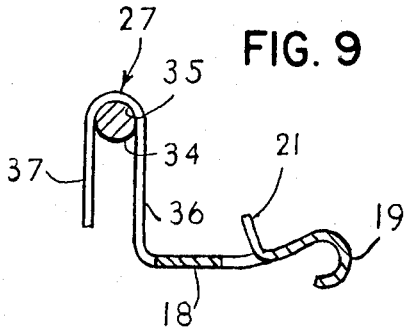
FIG. 9

SANDING SHOE

BACKGROUND OF THE INVENTION

This invention relates to improvements in hand-held portable sanding machines of the type having a power driven reciprocable shoe carrier to which a sanding shoe is attachable. More particularly, the invention is directed to the provision of an improved sanding shoe for such machines.

A feature of the improved shoe of the present invention lies in the organized arrangement of its components, and in the structure for securing a sheet of sandpaper to the shoe.

Another feature lies in the structure of the shoe whereby the tendency of the sandpaper to tear at its ends is reduced.

A further feature lies in the structure of clamping mechanism whereby the sandpaper is securely held in place against slipping or pulling free and whereby the clamping mechanism is restrained from being forced during operation of the tool to a released condition.

A still further feature lies in structure whereby an overcenter type lever for actuating the clamping mechanism is restrained from obtaining a possible jammed condition relative to its pivot support; and other means is provided for locking the lever in its actuated condition against being released by vibration of the tool.

In accordance with the invention, there is provided in a portable sanding machine including a reciprocable carrier plate, a sanding shoe attachable to the carrier plate for reciprocation with the latter, the sanding shoe comprising a rectangular base plate provided with upstanding studs for mounting it to the carrier plate, opposite ends of the base plate having a smooth surfaced bulbous formation over each of which an end of a sheet of sandpaper is adapted to be extended, and manipulative clamping means mounted upon each of the end surface areas proximate the bulbous ends of the base plate for clamping corresponding ends of the sandpaper to the shoe, the clamping means comprising a lower jaw fixed upon the base plate, an upper jaw angularly movable relative to the lower jaw having an integral back extension of spring material fixed to the base plate normally biasing the upper jaw to an open condition relative to the lower jaw, and a manipulative camming lever pivotally supported upon the base plate having cooperation with the back extension of the upper jaw when pivoted in a predetermined direction to cam the upper jaw angularly downward into the clamping relation with the lower jaw.

BRIEF DESCRIPTION OF THE DRAWING

In the accompanying drawing:

FIG. 4 is a view in elevation of the right end of FIG. 2;

FIG. 5 is a detail in top plan of the resilient upper jaw member;

FIG. 6 is a side elevation view of FIG. 5;

FIG. 7 is a section on line 7—7 of FIG. 5;

FIG. 8 is a detail of the bearing support for the camming lever, looking from the left end of FIG. 9; and FIG. 9 is a section on line 9—9 of FIG. 8.

DESCRIPTION OF PREFERRED EMBODIMENT

Figure 1:
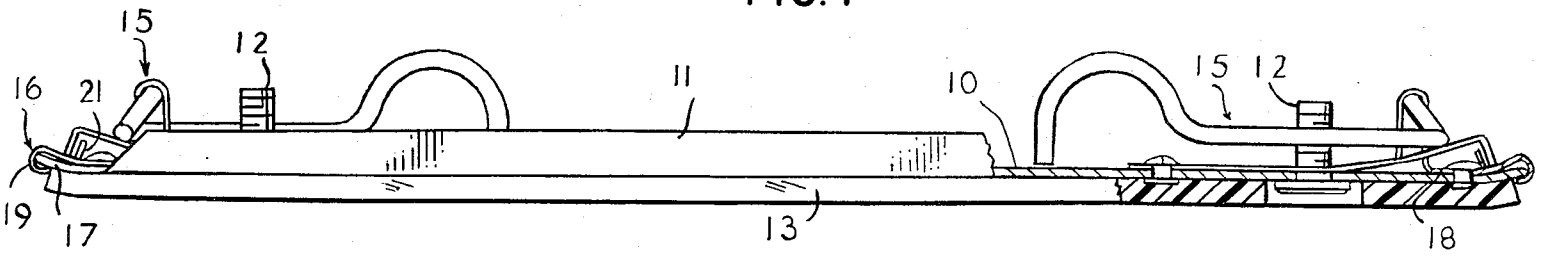
FIG. 1 is a view in side elevation of a sanding shoe embodying the invention.

The sanding shoe illustrated in the drawing as embodying the invention includes a supporting base plate 10 of general rectangular form, having short parallel side walls 11 so as to define an open ended shallow channel of squared configuration.

Figure 2:
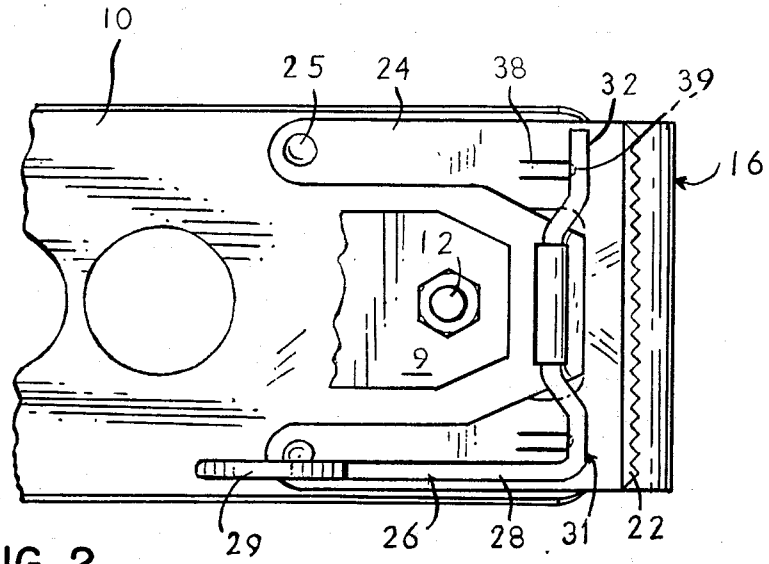
FIG. 2 is a detail in top plan of an end of the sanding shoe.

A threaded stud 12 is fixed to each of the end surface areas of the base plate as a means of supporting the shoe to the usual reciprocable carrier plate 9 of the tool, partly shown in FIG. 2.

Bonded to the undersurface of the base plate is a pad 13 of resilient material, such as foam rubber. The pad (FIG. 3) serves as a cushioned support for a rectangular long sheet of sandpaper 14 which is caused to be applied lengthwise over the pad. The free ends of the sandpaper pass over corresponding ends of the base plate to the upper surface of the latter. A separate clamping mechanism 15 is mounted to the surface area at each end of the base plate for securing a corresponding end of the sandpaper in place.

Figure 3:
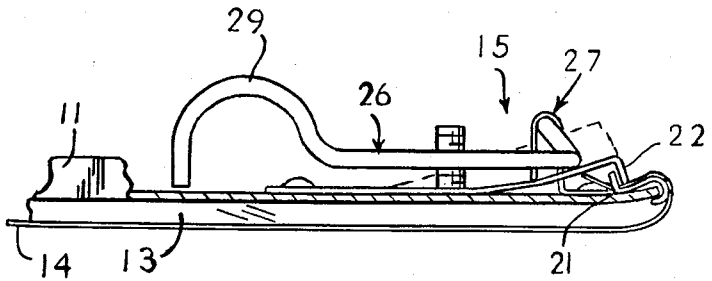
FIG. 3 is a detail in side elevation of an end of the sanding shoe directed to showing an end of the sheet of sandpaper in clamped condition.

Since the sandpaper is constantly subjected to push and pull forces transmitted to it by the reciprocating shoe in a sanding operation, there is a tendency for it to tear away in the areas where it passes over the corresponding ends of the base plate. To materially reduce this tendency, the ends of the base plate have been given a bulbous or large rounded configuration, as generally indicated at 16, instead of a squared edge. In this respect, the opposite ends of the base plate extend longitudinally beyond its side walls and curve slightly upward, as at 17. A tab 18 (FIGS. 1, 3, 8, 9) riveted to the surface of the base plate has an end in the form of a curved portion or hook 19 which is hooked over the free end of the base plate to define the bulbous formation. Each free end of the sandpaper is caused to extend over this smooth bulbous portion (as indicated in FIG. 3) before being engaged by the corresponding clamping mechanism. The ends of the pad 13 terminate at the point where the end of the curved portion of the tab abuts the undersurface of the base plate, as best seen in FIG. 1. It can be seen by means of this arrangement that, when a sheet of sandpaper is drawn tightly over the pad and its free ends secured in the clamping mechanisms, the resilient pad will be compressed (as indicated in FIG. 3) so as to spread below the underface of the curved portion of the tab to fill in voids and to cushion the sandpaper at the point where it rounds over the hook to the upper surface of the latter. Not only do the curved bulbous surfaces presented to the ends of the sanding shoe serve to reduce the tendency of the sandpaper to tear in this area, but they also cushion the sandpaper against possible damage when the ends of the shoe are bumped into walls and the like.

The clamping mechanisms 15 are also of advantage in that each provides a double jaw clamp to the related end of the sandpaper. This serves to offer a desirable resistance to the sandpaper being pulled free of the shoe.

Each clamping mechanism 15 includes a stationary lower jaw 21, and an upper jaw 22. The lower jaw 21 (FIGS. 1, 3, 8, 9) is defined by a group of teeth, here two stamped out of the tab, in lateral spaced relation to each other and projecting upwardly from the surface of the tab 18. The upper jaw 22 overhangs the lower jaw in parallel slightly forwardly spaced relation to the latter. The upper jaw is resiliently movable angularly upwardly and downwardly to open and closed positions relative to the lower jaw so as to release or clamp, as required, an end of a sheet of sandpaper to the base plate.

The upper jaw 22 is part of a jaw member (generally indicated at 20, FIGS. 6–8) formed of flat spring material. The jaw portion 22 is defined by a flange depending substantially at right angles from a web back section 23. The latter joins the forward ends of a pair of rearwardly extending legs 24. The legs are riveted at their free ends 25 to the surface of the base plate 10; and they extend forwardly to position the upper jaw 22 slightly forwardly and in overhanging parallel relation to the lower jaw.

The upper jaw is normally biased by the spring tension of its legs angularly upward to an open condition relative to the lower jaw (as indicated by the broken line in FIG. 3). This allows an end of the sandpaper to be passed under the upper jaw and then over the lower jaw. The jaws are preferably toothed to obtain a biting grip with the sandpaper.

The clamping mechanism includes a manipulative camming lever 26 which is pivotally supported in a pivot support or bearing element (generally indicated at 27) for camming the upper jaw downwardly into clamped relation to an end of a sheet of sandpaper inserted between the jaws.

The camming lever is of L-form and of the overcenter type. It includes a manipulative power arm section 28 having at its rear a finger grip 29. Offset laterally from the forward end of the power arm is a camming arm section (generally indicated 31). The latter includes (as best seen in FIGS. 2 and 4) a pair of laterally spaced end cam portions 32 disposed at right angles to the power arm. The cam portions overlie the forward surface area of the flat leg portions 24 of the upper jaw member. A pair of short sections 33 inclined or converging toward each other slope upwardly and rearwardly from the inner ends of the cam portions, and are bridged by a central pivot section 34. The latter extends parallel to the cam portions 32 and serves as a pivot or journal for the lever. The journal 34 is disposed in a bearing 35 (FIG. 9) defined in part by a panel 36 offset upwardly from the inner end of tab 18. The panel is disposed with some clearance between the legs of the upper jaw member to allow the latter to move freely upwardly or downwardly relative to it. Panel 36 then curves over at its upper end and depends downwardly to provide a second parellel panel 37 so as to define the inner bearing surface 35 for the journal 34. An inherent upward bias of the spring legs of the upper jaw member serves to maintain the journal in contact with the bearing surface 35.

In applying an end of a sheet of sandpaper to one of the clamps 15, it is first passed over the bulbous end 16 of the shoe and then passed over the teeth of the lower jaw. The upper jaw is then clamped downwardly to grip the sandpaper with its teeth and to cause the teeth of the lower jaw to pierce it, thus securing the sandpaper in place.

The camming lever 26 is pivotable about its bearing support in one direction to cam the upper jaw downwardly in a clamped condition; and is pivotable in a reverse direction to release the upper jaw from its clamped condition. Means defined by a pair of ribs 38 on the surface of the legs are cooperable with the cam portions 32 of the lever to insure a locked condition of the lever in its clamped position against possible release by vibratory forces developing during operation of the tool. In this respect, a rib 38 is located on the surface of each leg of the jaw member in the path of movement of the cam portions 32 of the lever. Each rib rises gently forwardly from the surface of the leg, and at its forward end provides a slightly rounded drop or abutment 39. It can be seen in this arrangement that, as the lever is pivoted to the clamped position, the cam portions 32 of the lever will ride over the ribs and drop in front of the abutments 39 as the lever obtains its clamped position. The abutments cooperate with the lever to lock it from slipping free of the clamped condition. When the lever is moved in a releasing direction, the cam portions 32 are forced by it downwardly against the resilient legs 24 so as to allow the cam portions to ride up and rearwardly over the abutments.

Means is also provided to centralize the camming arm 31 of the lever relative to the bearing support 35, so as to restrain it from sliding laterally free of this position and possibly obtaining a jammed condition. This means is defined by a pair of raised rounded projections or beads 41 at the forward end of the legs (as best seen in FIGS. 2 and 4-7). Beads 41 are disposed in underlying contact with the converging sections 33 of the camming arm 31. By means of this arrangement, the projections serve to guide and restrain the camming arm to a central position relative to the bearing 35 as the converging sections 33 ride over the projections in either direction.

I claim:

1. A sanding show comprising an elongated rectangular rigid base plate adapted for attachment to a reciprocable carrier in a sanding tool, the base plate having squared ends, a resilient pad fixed to the underside of the base plate providing a resilient backing for a sheet of sandpaper stretched over its bottom surface, and separate clamping means mounted upon opposite end areas of the upper surface of the base plate for clamping in place opposite ends of the sandpaper extended over corresponding ends of the base plate into the clamping means, wherein the clamping means at each end comprises a stationary lower jaw upon the base plate, an upper jaw movable angularly to and from a clamping relation with the lower jaw, the upper jaw depending from one end of a leaf spring back section that is fixed at its opposite end to the base plate, the back section biasing the upper jaw to a normally unclamped open condition relative to the lower jaw, a manipulative pivotable lever having a power arm from which is offset at right angles a camming arm abutting upon the back section, a bearing support upstanding from the base plate providing a bearing surface for pivoting of the camming arm, the camming arm being pivotable to cam the upper jaw angularly downward into clamping condition with the lower jaw upon actuation of the power arm angularly upward, a mounting tab extending from a lower end of the bearing support fixed upon the base plate having a curved end hooked over an adjacent end of the base plate so as to define a smooth rounded bulbous surface over which an end of a sheet of sandpaper may be extended and passed between the upper and lower jaws, and the tab having between its curved end and the bearing support a raised tooth defining the lower jaw.

2. A sanding show as in claim 1, wherein the upstanding bearing support has the configuration of an inverted U having forward and rear upstanding spaced panels joined together at the top by a bridge section, the bridge section having an inside radius defining a bearing surface, and the lower end of the rear panel being fixed to the tab; and the camming arm has a central section in pivotal bearing relation to the bearing surface.

3. A sanding shoe as in claim 2, wherein the camming arm includes externally of opposite ends of the bearing support a first cam section extending at right angles from the power arm, a second cam section in linear spaced relation to the first cam section, and a pair of rearwardly and upwardly sloping converging sections joining the first and second cam sections to opposite ends of the central section; and wherein a pair of round protuberances on the surface of the back extension of the upper jaw abut opposite inner areas of the converging sections so as to prevent endwise movement of the central section relative to the bearing support.

4. A sanding shoe as in claim 3, wherein the back extension of the upper jaw underlies the cam sections of the camming arm and exerts a constant upward biasing force through such cam sections to maintain the central section in bearing relation to the bearing support.

* * * * *